US011150044B1

(12) United States Patent
Cobb

(10) Patent No.: US 11,150,044 B1
(45) Date of Patent: Oct. 19, 2021

(54) ADJUSTABLE TENSION SYSTEM FOR FIREARM FIRE CONTROL MECHANISM

(71) Applicant: Adrian Cobb, Paso Robles, CA (US)

(72) Inventor: Adrian Cobb, Paso Robles, CA (US)

( * ) Notice: Subject to any disclaimer, the term of this patent is extended or adjusted under 35 U.S.C. 154(b) by 0 days.

(21) Appl. No.: 15/498,404

(22) Filed: Apr. 26, 2017

(51) Int. Cl.
*F41A 19/16* (2006.01)
*F41A 19/45* (2006.01)

(52) U.S. Cl.
CPC ..... *F41A 19/16* (2013.01); *F41A 19/45* (2013.01)

(58) Field of Classification Search
CPC ..... F41A 19/16; F41A 19/42; F41A 19/43; F41A 19/44; F41A 19/45
See application file for complete search history.

(56) References Cited

U.S. PATENT DOCUMENTS 1,227,668 A * 5/1917 Reising ..... F41A 3/26 89/154
2,984,037 A * 5/1961 Wilhelm ..... F41A 19/16 42/69.03
3,757,634 A * 9/1973 Uria ..... F41A 3/68 89/145
4,361,072 A * 11/1982 Karlsen ..... F41A 19/16 89/154
4,641,449 A * 2/1987 Kapland ..... F41C 3/14 42/65
5,386,659 A 2/1995 Vaid et al.
5,640,794 A 6/1997 Gardner et al.
6,016,619 A * 1/2000 Casull ..... F41A 19/16 42/65
6,205,694 B1 * 3/2001 Davis, Sr. ..... F41A 19/14 42/22
6,889,459 B1 5/2005 Salvitti
2006/0150466 A1 * 7/2006 Hochstrate ..... F41A 19/45 42/69.03

OTHER PUBLICATIONS

Novak Custom Next. <https://www.handgunsmag.com/editorial/featured_handguns_hg_novakcustom_201009/138612>. Sep. 24, 2010. (Year: 2010).*
Novak Answer. <https://www.1911addicts.com/threads/novak-answer-backstrap-aluminum-in-the-white.42071/>. Jan. 1, 2018. (Year: 2018).*

* cited by examiner

*Primary Examiner* — Gabriel J. Klein
(74) *Attorney, Agent, or Firm* — Richard A. Ryan

(57) ABSTRACT

A system that allows a person to adjust the tension of the fire control mechanism of a firearm from outside the firearm so the firearm does not need to be disassembled to make such adjustments. The system has a modified mainspring housing that supports one or more spring engaging mechanisms which engage the sear spring of the fire control mechanism. In one configuration, first and second apertures extend through the housing body and an engaging device, such as a screw, is received in each aperture to contact different segments of the sear spring. From outside the firearm, the user moves the devices forward or rearward in the apertures to apply more or less force to the subject sear spring segment to adjust the tension of the fire control mechanism. The sear spring is modified so each engaged segment has an enlarged area that is contacted by its engaging device.

21 Claims, 8 Drawing Sheets

ADJUSTABLE TENSION SYSTEM FOR FIREARM FIRE CONTROL MECHANISM

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention generally relates to devices and systems that improve the use and operation of firearms, particularly handguns. More particularly, the present invention relates to such devices and systems that allow a person to adjust the tension of the fire control mechanism of a firearm, such as a 1911-style handgun. Even more particularly, this invention relates to such devices and systems which allows the person to externally adjust the tension of the fire control mechanism.

B. Background

Many people own and utilize firearms for work purposes, competition and/or personal safety. A common style of firearm is a handgun that is based on the Colt 1911 model handgun, which has been the standard handgun for numerous military, police and related organizations for many years. The 1911-style handgun utilizes a standard size magazine that, like all firearm magazines, comprises an elongated multiple round magazine tube having upstanding side walls that define a cartridge chamber which receives a plurality of cartridges that are utilized by the handgun. As with nearly all semi-automatic handguns, a 1911-style handgun uses part of the energy released from firing one cartridge to load the next cartridge into the firing chamber of the handgun. More specifically, the energy taken up by the recoil of the slide component is utilized to push the next cartridge in the magazine up into the firing chamber. The slide, which is moveably associated with the barrel, is supported by the handgun's frame. The handle, which is defined by the frame, is hollow so it may removably receive the magazine. The trigger is movably operated inside the trigger guard of the frame. A fire control mechanism controls the release of the trigger to fire the handgun.

The fire control mechanism of a typical 1911-style handgun comprises the trigger, a trigger bar attached to the trigger, a hammer, a firing pin, a firing pin spring, a sear, a disconnector, a sear/disconnector pin and a sear spring. As well known to persons skilled in the art, pulling on the trigger causes the sear to release the hammer, which is loaded by the sear spring, causing the hammer to pivot forward and hit the firing pin, which is driven forward to the chambered cartridge. The firing pin contacts the primer on the shell casing, causing it to detonate the powder in the casing and propel the bullet portion of the cartridge forward from the casing and through the barrel and out the muzzle of the handgun. The slide of the handgun recoils as a result of the detonation of the cartridge. A recoil spring controls the recoil of the slide and returns the slide to its pre-fired position. The recoil of the slide is utilized to eject the empty shell casing and to chamber the next cartridge in the firing chamber. The rearward movement of the trigger is transmitted to the trigger bar, which moves the sear to cause compression and release the firing pin spring, which fires the handgun. The recoil of the slide, which results from the handgun firing, causes the trigger bar to be deflected downwardly, which disconnects the trigger bar from the sear and allows the sear spring, along with the mainspring, to reposition the sear to its forward or "ready" position for the next firing cycle. Handgun fire control mechanisms, which are well known to those skilled in the relevant art, are described in U.S. Pat. No. 5,386,659 to Vaid, et al. and U.S. Pat. No. 5,640,794 to Gardner, et al.

The sear, which is a key component of the fire control mechanism, is connected to a disconnector that, after a cycle of semi-automatic fire has taken place, keeps the hammer in place until the trigger is released and the sear takes over. The 1911-style handgun, as well as others, has a notch in the side of the handgun which the top end of the disconnector returns to after the trigger is released. When the trigger is still under pressure by the firearm operator, the disconnector will not retract to its resting position. The trigger pull of the handgun is related to the interaction of the sear with the trigger.

As set forth above, the fire control mechanism of a typical 1911-style handgun controls the release of the trigger to fire the handgun. The components of the fire control mechanism are tensioned by the common sear spring, which is a segmented leaf spring. The sear and the disconnector are each tensioned by one of the segments of the sear spring (i.e., the segmented leaf spring), with the left or long segment providing tension for the sear, the middle segment providing tension for the disconnector and the right or shortest segment controls the grip safety. A person using the handgun may want to adjust the tension of one or more of the segments of the sear spring to achieve a particular desired firing performance for the handgun. As well known in the art, however, partial disassembly of the handgun is required in order to access the sear spring so the user may make the tension adjustments on a segment or segments of the sear spring. The classic method of making such adjustments, after disassembly, is to manually bend one or more of the spring segments, reassemble the handgun and test the performance of the handgun. This disassembly, bending, reassembly and test process is repeated until the desired fire control tension is achieved.

The segmented sear spring is housed in the frame of the handgun toward the back of the handgun grip forward of the mainspring housing, in which is received the mainspring. The mainspring housing pushes against the lower portion of the sear spring. The upper portion of the sear spring, which has the segmented sections, engages the sear, disconnector and grip safety. In order to access the sear spring to adjust the tension of one or more of the segments, the user must disassemble the back of the handgun. Specifically, the user has to remove the mainspring housing, which is held in place by the mainspring pin, by pushing the pin out of the aligned apertures in the frame and mainspring housing, slide the mainspring housing off of the handgun frame and remove the grip safety. Once these components are removed, the user can remove the sear spring from the handgun and bend one or more segments to adjust the tension between the sear spring and the sear, disconnector and/or grip safety.

As well known by persons familiar with 1911-style handguns, the removal and adjustment of the sear spring is somewhat tedious due to its inherent trial and error adjustment process. In addition, if sufficient care is not taken, the user can damage one or more segments of the sear spring, which is likely to make the handgun unavailable for use until the sear spring is replaced. Due to the inexact nature of such adjustments and the risk of damage, many people prefer to have a professional gunsmith make the adjustments. Generally, this is relatively expensive due to the time necessary for the gunsmith to make the adjustments.

What is needed, therefore, is an improved system for adjusting the tension of the fire control mechanism of a firearm, particularly handguns such as the 1911-style handgun. The new system should allow a person to easily and quickly adjust the tension of the sear spring so as to modify the performance of one or more components of the fire control mechanism of a firearm. Preferably, the new system should be configured to eliminate the need for the user to have to disassemble the handgun and to remove the sear spring from the handgun. In addition, it is preferred that the new system be configured to eliminate the user having to manually bend one or more segments of the sear spring so as to reduce the risk of damaging the sear spring. The system for adjusting the tension of the fire control mechanism should be adaptable to easily retrofit an existing firearm without requiring significant modification to the firearm. In addition, it is generally preferred that the new system should be relatively inexpensive to manufacture.

SUMMARY OF THE INVENTION

The adjustable tension system of the present invention provides the benefits and solves the problems identified above. That is to say, the adjustable tension system of the present invention is structured and arranged to significantly simplify the tension adjustments of a fire control system for a firearm, particularly handguns such as the 1911-style handgun. More specifically, the new adjustable tension system of the present invention allows a person to easily and quickly adjust the tension of the sear spring so he or she can modify the performance of one or more components of the fire control mechanism of the firearm. Once installed on a handgun, the new system is structured and arranged such that it eliminates the requirement for the user to disassemble the handgun, remove the sear spring from the handgun and to manually bend one or more segments of the sear spring. As such, the adjustable tension system of the present invention reduces the time necessary to adjust the fire control mechanism and eliminates the risk of damaging the sear spring due to excessive manual bending. In addition, the new system will allow most people to be able to adjust the tension of the components of the fire control mechanism without having to have the assistance of a gunsmith or another person, thereby eliminating any costs associated with such assistance. In its preferred configuration, the new system for adjusting the tension of the fire control mechanism can be easily retrofitted into existing firearms without requiring any modification to the firearm, other than replacing the existing mainspring housing. In the preferred configuration of the new system, the new adjustable tension system is relatively inexpensive to manufacture.

In one embodiment of the system of the present invention, the new adjustable tension system for use with a firearm generally comprises a modified mainspring housing and a spring engaging mechanism that is supported by the mainspring housing and configured to be able to selectively engage the sear spring, which in the preferred embodiment is also modified for use with the present invention, in the firearm when the mainspring housing is attached to or integral with the firearm to allow a person to adjust the tension of the fire control mechanism from outside the firearm, thereby avoiding the need to disassemble the firearm. The mainspring housing is attached to or integrally formed with the firearm so as to be positioned at or near the fire control mechanism thereof with the back wall of the housing body facing generally outward at a rearward end of the firearm. In the 1911-style handgun, the mainspring housing is positioned at the rearward end of the frame at the handle. The spring engaging mechanism comprises one or more engaging devices that are each movably received in separate device apertures that extend through the back wall of the housing body of the mainspring housing. Each spring engaging mechanism has a first end that is accessible from rearward of the back wall of the housing body (i.e., outside the firearm) and a second end that extends forward of the housing body to abut the sear spring. The first end of the spring engaging mechanism is configured so as to be operatively engaged, such as by an Allen wrench, screwdriver, wrench or directly by the user (i.e., having a rotatable button, wing nut or like device), to move the spring engaging mechanism forward and rearward in the aperture to apply more or less force against the sear spring, which adjusts the tension of the fire control mechanism. Each device aperture is positioned so as to align one of the engaging devices with one of the segments of the sear spring, which has at least a sear segment and a disconnector segment, such that movement of one of the engaging devices in its device aperture will apply more or less force against one of the sear segment or the disconnector segment to increase or decrease the tension in the firearm fire control system. In a preferred configuration, the spring engaging mechanism is an engaging device, such as a set screw, screw, bolt or like element, that is threadably received in the device aperture.

In one embodiment, the mainspring housing is sized and configured to be removably attached to a frame of the firearm (i.e., at the handle of a 1911-style handgun). In a preferred configuration, the housing body has a first sidewall, a second sidewall and a pin aperture that extends between the first sidewall and the second sidewall to receive a housing pin that removably secures the mainspring housing to the frame. Typically, for 1911-style handguns and the like, each of the first sidewall and the second sidewall of the mainspring housing will also be cooperatively configured with the handle of the firearm so the mainspring housing can be slidably engaged with the handle. In a typical configuration of the new mainspring housing, the housing body has an upper end, a lower end, a front wall, a first sidewall, a second sidewall and a spring passageway that extends vertically (when the firearm is held in its normal firing position) between the upper end and the lower end of the housing body. As with the prior art, the spring passageway has a mainspring disposed therein between a mainspring cap positioned at or near the upper end of the mainspring body and a pin retainer positioned at or near the lower end of the mainspring body.

In another embodiment of the system of the present invention, the new adjustable tension system comprises a mainspring housing, a mainspring disposed in the mainspring housing and a spring engaging mechanism that is supported by the mainspring housing for selectively engaging a modified sear spring when the mainspring housing is attached to the firearm to allow the user to adjust the tension of the fire control mechanism. The mainspring housing has a housing body with an upper end, a lower end, a front wall, a back wall, a first sidewall, a second sidewall and a spring passageway extending between the upper end and the lower end of the housing body. The mainspring housing is removably attached to the firearm at or near the fire control mechanism thereof with the back wall facing outward of a rearward end of the firearm and the forward wall facing forward into the firearm generally toward the sear spring of the fire control mechanism. The mainspring is disposed in the spring passageway of the housing body of the mainspring housing between a mainspring cap at or near the upper end of the housing body and a pin retainer at or near the lower end of the housing body. Each of the mainspring cap, pin retainer and mainspring are removably received in the spring passageway from the lower end of the housing body, which is opposite the prior art configuration. In the preferred configuration, the mainspring cap and the opening into the spring passageway (to receive the lower end of the hammer strut) at the upper end of the housing body are cooperatively sized and configured to prevent the mainspring cap from exiting the spring passageway at the upper end of the housing body. As with the prior art configuration, the upper surface of the mainspring cap is engaged by the hammer strut of the firearm when the mainspring housing is attached to the firearm. The pin retainer, which engages the lower end of the mainspring, is received into the spring passageway through an opening at the lower end of the housing body. A securing pin at or near the lower end of the housing body of the mainspring housing secures the pin retainer and, therefore, the mainspring inside the spring passageway of the mainspring housing.

In a preferred embodiment of the new adjustable tension system, the spring engaging mechanism comprises a first engaging device that is moveably disposed in a first device aperture and a second engaging device that is movably disposed in a second device aperture. Each device aperture extends between the front and back walls of the housing body. The first device aperture is positioned to align the first engaging device with the sear segment of the sear spring and the second device aperture is positioned to align the second engaging device with the disconnector segment of the sear spring. Each of the engaging devices has a first end accessible from rearward of the back wall of the housing body and a second end that extends forward of the front wall of the housing body to abut against the respective segment (i.e., sear segment or disconnector segment) of the sear spring. The first end of each of the engaging devices are configured to be operatively engaged to move the spring engaging mechanism forward and rearward in the device aperture to apply more or less force against the respective segment (i.e., the sear segment or the disconnector segment) of the sear spring to adjust the tension of the fire control mechanism. The engaging devices can be threadably received in their respective device apertures. In a preferred configuration of the new system, the sear spring is also modified to have an enlarged area in each of the sear segment and the disconnector segment so each of these segments can be better engaged by the second ends of the respective engaging devices. An enlarged area can be angled to improve the contact with an engaging device.

Accordingly, the primary object of the present invention is to provide a new system for adjusting the components of a fire control mechanism of a firearm that has the advantages discussed above and elsewhere in the present disclosure and, when utilized with a firearm, overcomes the various disadvantages and limitations that are associated with presently available apparatuses, systems and methods for adjusting the fire control mechanism of a firearm.

It is an important objective of the present invention to provide a new adjustable tension system that, when utilized with a firearm, is structured and arranged to allow a person to easily and quickly adjust the tension components of the fire control mechanism of the firearm, particularly handguns such as a 1911-style handgun.

It is also an important objective of the present invention to provide a new adjustable tension system which is adaptable for use with a variety of firearms and which, when installed, allows adjustment of the fire control mechanism of a firearm without requiring disassembly of the firearm to make such adjustments.

An important aspect of the present invention is that it provides a new adjustable tension system for adjusting the fire control mechanism of a firearm that achieves the goals of the above-described objectives.

Another important aspect of the present invention is that it provides a new adjustable tension system that allows a person to easily and quickly adjust the tension of the sear spring so he or she can modify the performance of one or more components of the fire control mechanism of the firearm.

Another important aspect of the present invention is that it provides a new adjustable tension system which is structured and arranged to eliminate the requirement for the user to disassemble the handgun, remove the sear spring from the handgun and to manually bend one or more segments of the sear spring to adjust the tension of the fire control mechanism.

Another important aspect of the present invention is that it provides a new adjustable tension system that reduces the time necessary to adjust the fire control mechanism and eliminates the risk of damaging the sear spring due to excessive manual bending of one or more of the spring segments.

Another important aspect of the present invention is that it provides a new adjustable tension system that allows people to adjust the tension of one or more components of the fire control mechanism of a firearm without having to have the assistance of a gunsmith or another person, thereby eliminating any costs associated with such assistance.

Yet another important aspect of the present invention is that it provides a new adjustable tension system that is adaptable to being manufactured out of a variety of materials and is relatively inexpensive to manufacture.

As will be explained in greater detail by reference to the attached figures and the description of the preferred embodiments which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. As will be readily understood and appreciated, the scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
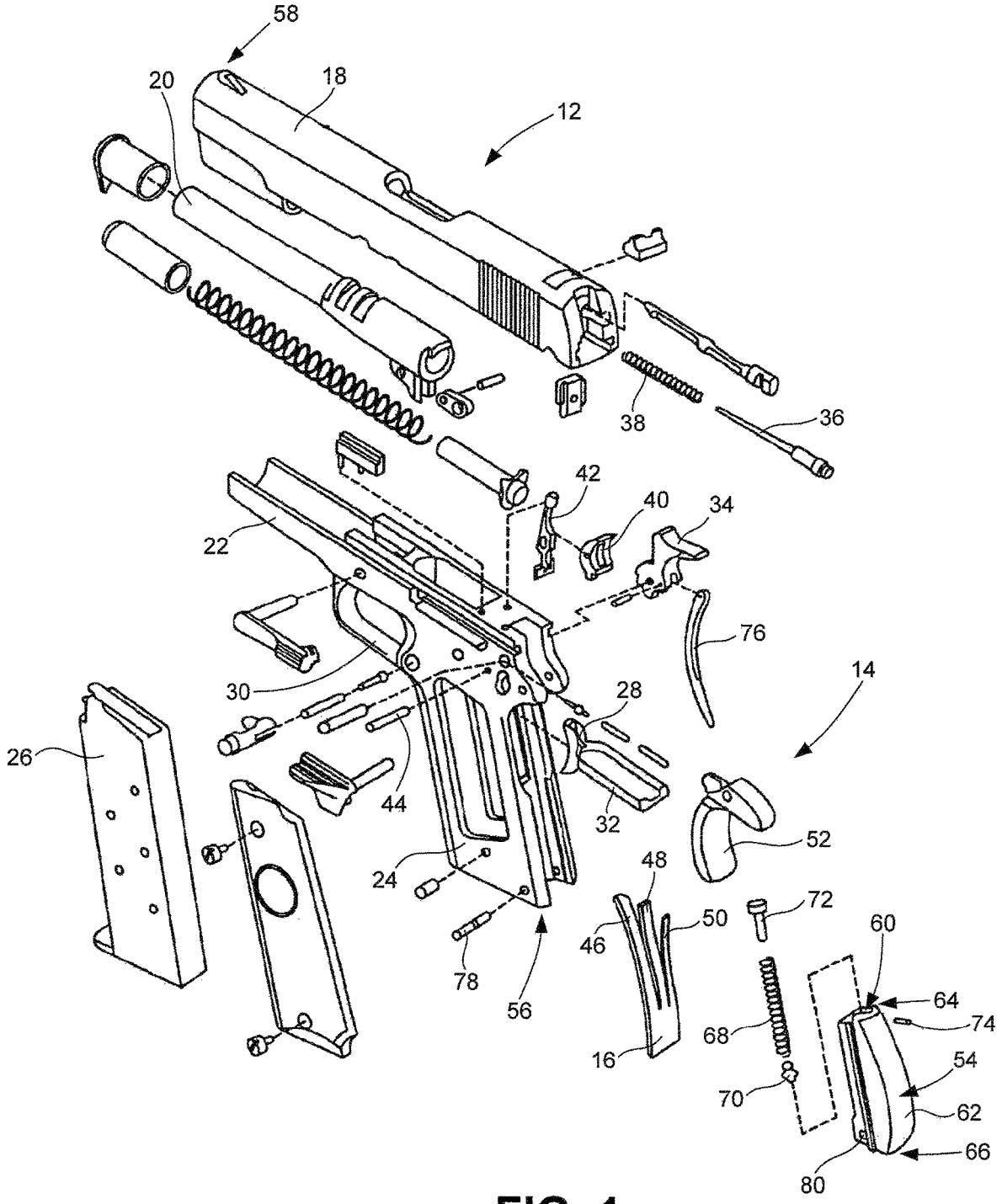
FIG. 1 (PRIOR ART)
FIG. 1 is an exploded view of a prior art 1911-style handgun showing the components thereof and particularly identifying the components of the fire control mechanism relevant to the present invention.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the system of the present invention and a firearm with which it can be utilized, those persons who are skilled in the art will readily appreciate that the present invention is not so limited. In addition, the exemplary embodiments of the present device are shown and described with only those components which are required to disclose the present invention. It may be that some of the necessary elements for attaching and using the present invention are not shown or are not necessarily described below, but which are well known to persons skilled in the relevant art. As will be readily appreciated by such persons, the various elements of the present invention that are described below may take on any form consistent with forms that are readily realized by persons of ordinary skill in the art having knowledge of firearms and fire control mechanisms utilized with such firearms.

An adjustable tension system that is configured pursuant to one of the preferred embodiments of the present invention is shown generally as 10 in FIGS. 2-4 and 15-16. As set forth in more detail below, the adjustable tension system 10 of the present invention (hereinafter, the "system") is structured and arranged for use with a firearm 12, such as the 1911-style handgun shown in FIG. 1, to allow the user to more easily and quickly adjust the tension of the fire control mechanism 14 of the firearm 12. More specifically, the new system 10 of the present invention is structured and arranged to allow the user to adjust the tension of the fire control mechanism 14 without having to disassemble the firearm 12 or to manually bend the sear spring 16. The example firearm 12 shown in FIG. 1, which is a 1911-style handgun, has a slide 18 that is moveably associated with a barrel 20, which is fixedly supported by the handgun's frame 22. The handle 24, which is defined by the frame 22, is hollow so it may removably receive magazine 26 which stores a plurality of cartridges (not shown). The trigger 28 is movably operated inside the trigger guard 30 of the frame 22. The fire control mechanism 14 controls the release of the trigger 28 to fire the firearm 12.

As shown in FIG. 1, the prior art fire control mechanism 14 of a typical 1911-style handgun comprises the trigger 28, a trigger bar 32 which is attached to or integral with the trigger 28, a hammer 34, a firing pin 36, a firing pin spring 38, a sear 40, a disconnector 42, a sear/disconnector pin 44 and the sear spring 16. The sear spring 16 is a segmented leaf spring having a sear segment 46 (the left or long segment), a disconnector segment 48 (the middle segment) and the safety segment 50, as shown in FIG. 1. The sear 40 is tensioned by the sear segment 46 and the disconnector 42 is tensioned by the disconnector segment 48. The safety segment engages the grip safety 52. The tension provided by the sear segment 46 and disconnector segment 48 of the sear spring 16 affect the firing performance of the firearm 12. A person using the firearm 12 may want to adjust the tension of the sear segment 46 and/or disconnector segment 48 of the sear spring 16 to achieve a particular firing performance for the firearm 12. As set forth in the Background, the prior art methods of adjusting the tension of one or more of these segments 46/48, which typically includes manually bending the segments 46/48, requires the user to partially disassemble the firearm 12 in order to access the sear spring 16. After bending the segments 46/48, the user reassembles the firearm 12, tests the firing performance of the fire control mechanism 14 and, if the performance is not as desired, the user repeats the disassembly, bending, reassembly and testing process until he or she obtains the desired performance.

To access the sear spring 16 in the prior art fire control mechanism, the user must first remove the prior art mainspring housing 54 from the rearward end 56 of the firearm frame 22. For purposes of explaining the present invention, the terms "back" or "rearward" and "front" or "forward" (as well as like directionally functional terms) are utilized to generally identify a location relative to how those terms are normally utilized with the firearm 12. For instance, back or rearward is used to refer to the area at or facing away from where the user grips the handle 24, that is opposite the forward end 58 of the firearm 12, which is used to identify a location at, towards or facing in the direction of the end of the barrel 20 where the bullet exits the firearm 12. As well known in the art, the prior art mainspring housing 54 has a spring passage 60 that extends through the housing body 62 of the mainspring housing 54 from the upper end 64 to the lower end 66 thereof, as shown in FIG. 1. The mainspring 68 is enclosed in the spring passage 60 by a pin retainer 70 that is positioned in the spring passageway 60 at the lower end 66 of the mainspring housing 54 and a mainspring cap 72 at the upper end 64. A cap pin 74 engages the mainspring cap 72 to secure the pin retainer 70, mainspring 68 and mainspring cap 72 in the spring passageway 60. The lower end of the hammer strut 76, which engages hammer 34, presses against the upper surface of the mainspring cap 72, which is biased upward by the mainspring 68. The mainspring housing 54 is slid into the rearward end 56 of the frame 22 (with the sides of the mainspring housing 54 and the rearward end 56 of frame 22 being cooperatively configured) and is held in place by a mainspring housing pin 78 that is received through a pair of opposing apertures (not numbered) in the frame 22 and a pin aperture 80 that is generally at or near the lower end 66 of mainspring housing 54, as shown in FIG. 1. As indicated by the dashed lines shown on FIG. 1, the pin retainer 70, mainspring 68 and mainspring cap 72 are received (in that order) into the spring passageway 60 of the mainspring housing 54 from the upper end 64 of the housing body 62.

With regard to the prior art fire control mechanism 14, access to the sear spring 16 to make any changes (i.e., bends) to one or more of the segments 46/48/50 thereof requires the user to disengage the mainspring housing pin 78 from the frame 22 and mainspring housing 54 and slide the mainspring housing 54 off of the frame 22. The sear spring 16 can then be removed from the firearm 12 and the bending action applied. Often the trigger bar 32, trigger 28 and/or grip safety 52 will also be removed from the firearm 12. As set forth above, this is a trial and error process that usually requires the person making the tension adjustments to reassemble the firearm 12 and re-test the fire control mechanism 14. If any further adjustments to the fire control mechanism 14 are needed, the user must repeat the disassembly, bending, reassembly and testing process.

The new adjustable tension system 10 of the present invention significantly simplifies the process of adjusting the tension of the sear segment 46 and the disconnector segment 48 of the sear spring 16 to affect the performance of the fire control mechanism 14. The new adjustable tension system 10 generally comprises a modified mainspring housing, shown as 82 in FIGS. 2-11 and 15-16, that is adapted to accomplish the various objectives of the system 10 of the present invention. More specifically, the system 10 of the present invention utilizes the modified mainspring housing 82 to allow the user to adjust the sear segment 46 and the disconnector segment 48 of the sear spring 16 to affect the tension applied to the, respectively, sear 40 and disconnector 42 to adjust the operating characteristics of the fire control mechanism 14 of the firearm 12 without having to disassemble the firearm 12. Even more specifically, the system 10 of the present invention utilizes the modified mainspring housing 82 to allow the user to very quickly and easily adjust the tension of the sear spring 16 from outside the firearm 13 (i.e., at the back of the handle 24 at the rearward end 56).

For purposes of describing the new mainspring housing 82 of the system 10 of the present invention, the same part names and descriptions are utilized as for the prior art mainspring housing 54 where the common features of the new mainspring housing 82 exist. For instance, the modified mainspring housing 82 has the following components: (1) a housing body 62 with an upper end 64 and a lower end 66; (2) a spring passageway 60 that extends from the upper end 64 to the lower end 66 to receive the mainspring 68; (3) sidewalls that are cooperatively configured with the frame 22 so the mainspring housing 82 is slidably engaged by the frame 22; and (4) a pin aperture 80 that is sized and configured to receive the mainspring housing pin 78 to secure the mainspring housing 82 to the frame 22. Except for the modifications described below, the mainspring housing 82 is sized and configured to be exactly the same as the prior art mainspring housing 54 so as to fit into the firearm 12 in the same manner and to function in the firearm 12 in exactly the same manner (i.e., with regard to the hammer strut 76 and hammer 34). The mainspring housing 82 of the present invention has a front wall 84 that faces forward (i.e., toward the forward end 58 of the firearm 12) when the mainspring housing 82 is placed in firearm 12, a back wall 86 that faces rearward or to the outside of firearm 12 when the new mainspring housing 82 is placed in firearm 12, a first or left sidewall 88 and a second or right sidewall 90 (with the terms "left" and "right" being in reference to the sides of the firearm 12 from the user's perspective when being held in its normal manner by the user). The system 10 of the present invention comprises the new mainspring housing 82, a spring engaging mechanism 92, a retainer securing mechanism 94, a pin retainer 70 and a mainspring cap 72, as best shown in FIGS. 2-6 and 12-16. The configuration and function of these components are set forth below. In one of the preferred embodiments of the system 10 of the present invention, the pin retainer 70 and the mainspring cap 72 are the same components that are utilized in the prior art fire control mechanism 14, an example of which is shown in FIG. 1.

Figure 2:
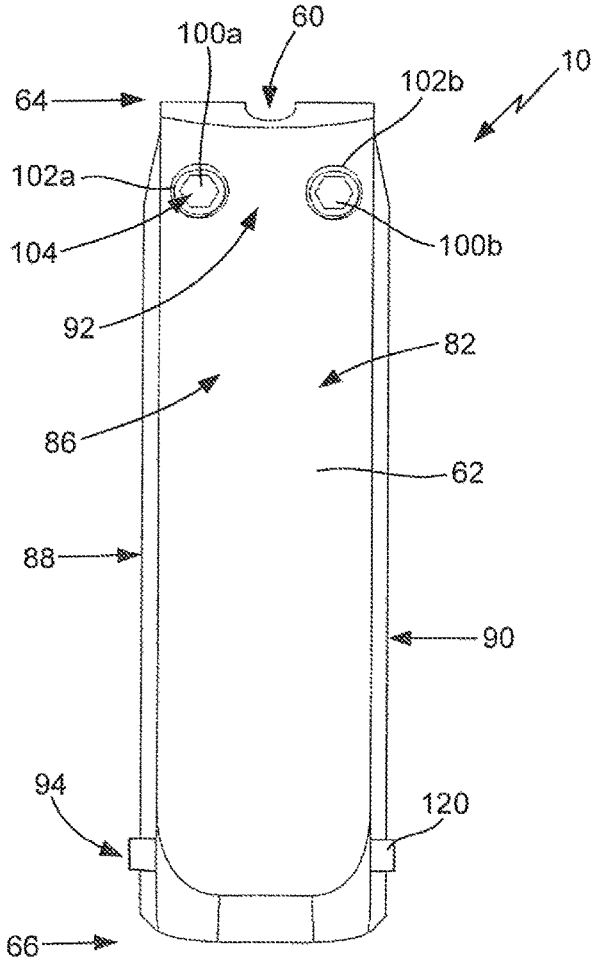
FIG. 2 is a back view of the mainspring housing component of an adjustable tension system that is configured to one of the preferred embodiments of the present invention showing the use of a pair of set screws as the engaging mechanisms and a pin as the securing device.
Figure 3:
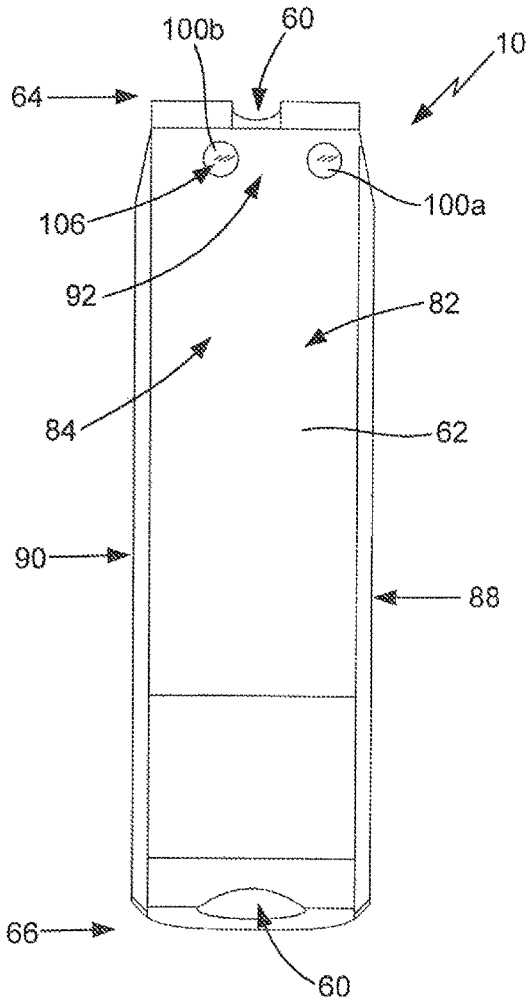
FIG. 3 is a front view of the mainspring housing of FIG. 2.
Figure 4:
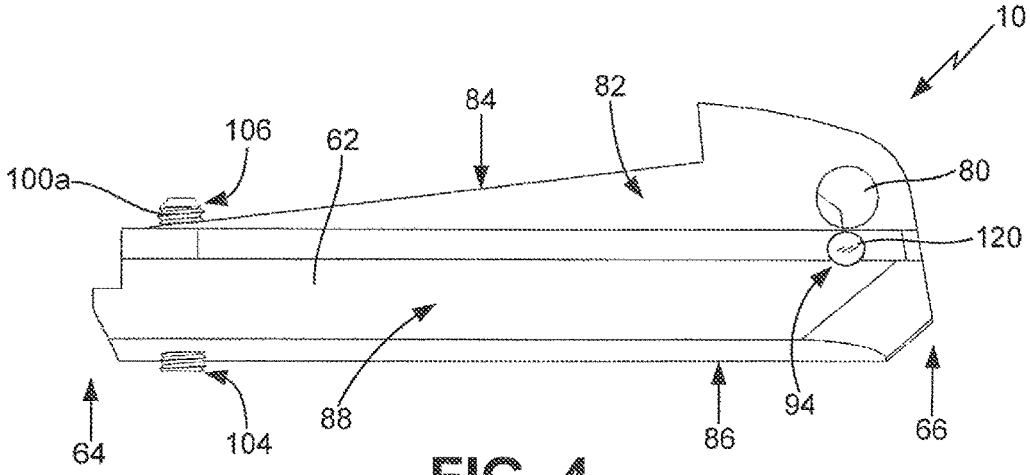
FIG. 4 is a left side view of the mainspring housing of FIG. 2.

In a preferred configuration of the system 10 of the present invention, the spring engaging mechanism 92 comprises one or more engaging devices 100 that are sized and configured to move relative to the new mainspring housing 82 to engage, to a more or less extent, the sear spring 16. The engaging device 100 moves in a device aperture 102 that extends through the housing body 62 between the front wall 84 and the back wall 86, as shown in FIGS. 2-11. In the embodiment that is shown in the figures, the spring engaging mechanism 92 comprises a first engaging device 100*a* and a second engaging device 100*b* that are, respectively, moveably received in a first device aperture 102*a* and a second device aperture 102*b*. In the figures, each of the engaging devices 100 is a set screw that is threadably received in their respective device aperture 102, with the first or key engaging end 104 extending outward from the back wall 86, as shown in FIGS. 2 and 4, and the second or spring engaging end 106 extending inward (i.e., towards the sear spring 16 in the handle 24 of frame 22) from the front wall 84, as shown in FIGS. 3 and 4. In this embodiment, the set screws (engaging devices 100) are threadably received in their respective device apertures 102 so a set screw key can be utilized to threadably move the engaging devices 100 inward or outward to, respectively, apply more or less force to the sear spring 16. The first engaging device 100*a* is positioned in the mainspring housing 82, by the first device aperture 102*a*, so as to moveably engage the sear segment 46 of the sear spring 16 and the second engaging device 100*b* is positioned in the mainspring housing 82, by the second device aperture 102*b*, so as to moveably engage the disconnector segment 48 of the sear spring 16.

When the firearm 12 is assembled with the new mainspring housing 82 in place, the spring engaging ends 106 of each engaging device 100 will be in abutting relation to the respective segment 46/48 of the sear spring 16 such that rotational movement of a set screw (engaging devices 100), by using a key at the key engaging end 104, will either result in more or less force, depending on which way the set screw is rotated (namely, inward or outward), by the spring engaging end 106 against the respective segment 46/48 of the sear spring 16. More specifically, rotational movement of the first engaging device 100*a* relative to the first device aperture 102*a* in the housing body 62 will either apply more or less force against the sear segment 46 of the sear spring 16 and rotational movement of the second engaging device 100*b* relative to the second device aperture 102*b* in the housing body 62 will either apply more or less force against the disconnector segment 48 of the sear spring 16. This more or less force will result in an increase or a decrease in the tension applied to the sear 40 and/or the disconnector 42, which will modify the operation of the fire control mechanism 14 of firearm 12. This change in force obtained by the new system 10, which was previously achieved by having to remove the sear spring 16 from the firearm 12, bend one or more of the segments 46/48 and then place the sear spring 16 back into the firearm 12, allows the user to easily and quickly obtain the tension characteristics for the fire control mechanism 14 that he or she desires without having to disassemble the firearm 12. As will be readily appreciated by persons who are skilled in the relevant art, use of the new system 10 will be considered to be a major time and/or expense benefit for the user.

As will also be readily appreciated by persons skilled in the art, a wide variety of devices may be utilized for the engaging devices 100. Although the use of set screws has certain well known advantages, the engaging devices 100 can be other types of screws, bolts and the like that may be threadably received in the device apertures 102 and sized and configured to engage the sear spring 16 to apply more or less force on one of the segments 46/48 of the sear spring 16 so as to modify the characteristics of the fire control mechanism 14 of the firearm 12. In addition, it is likely that there are other types of devices that can be utilized as the engaging devices 100, such as devices which are not threadably received in the device apertures 102 (but which are still moveably received in the device apertures 102) to accomplish the same objectives and achieve the same benefits as the engaging devices 100 which are threadably received in the device apertures 102 for the system 10 of the present invention.

Figure 5:
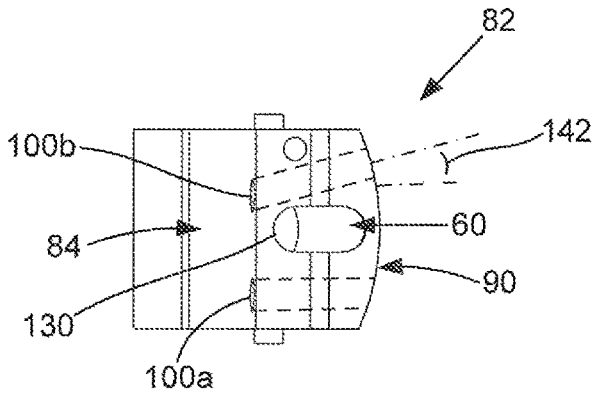
FIG. 5 is a top view of the mainspring housing of FIG. 2.

The device apertures 102 must be drilled through the housing body 62 of the mainspring housing 82 in a manner that achieves the objectives of the present invention without interfering with the operation of the mainspring 86 which is biased in the spring passageway 60. More specifically, the device apertures 102 must pass entirely through the housing body 62 between the front wall 84 and the back wall 86 without passing through or otherwise interfering with the operation of the mainspring 86 in the spring passageway 60 and be at a location where the second or spring engaging ends 106 of the engaging devices 100 will contact and be able to press against the respective segments 46/48 of the sear spring 16 to allow the user to achieve the desired movement of the segments 46/48 that will adjust the tension on the sear 40 and/or disconnector 42. To achieve the above, the device apertures 102 are drilled at angles through the housing body 62, instead of straight through the housing body 62. The exact angles, dimensions and other characteristics of the device apertures 102 will depend on the relative sizes and/or location of the sear spring 16, the segments 46/48, the engaging devices 100 and the spring passageway 60 (which may be affected by the size of the mainspring 68). In addition to the foregoing, at least a portion of the spring passageway 60 may need to be enlarged and/or have the shape thereof changed to accommodate the device apertures 102 to avoid the engaging devices 100 interfering with the spring passageway 60 and the operation of the mainspring 68. In the embodiment shown in the figures, the interference avoidance is achieved by providing an oval shaped spring passageway 60 at and near the upper end 64 of the mainspring housing 82, as best shown in FIG. 5.

Figure 6:
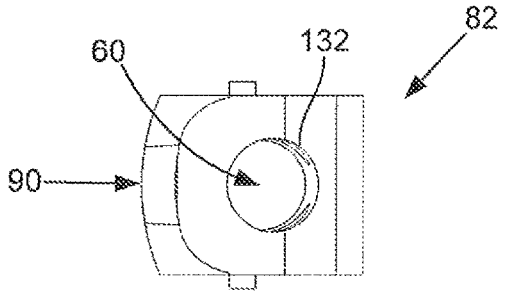
FIG. 6 is a bottom view of the mainspring housing of FIG. 2.
Figure 7:
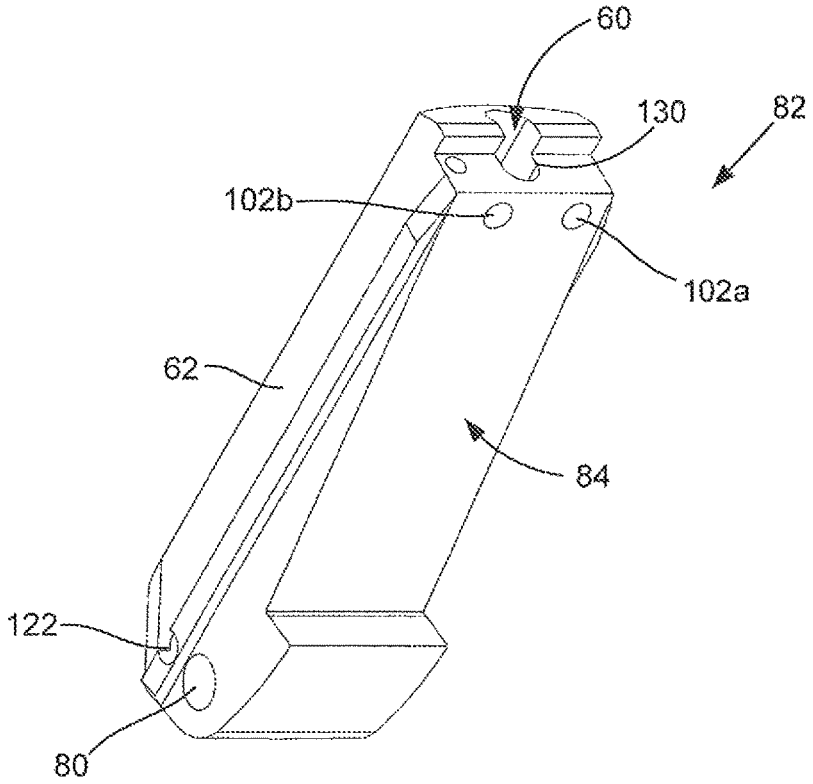
FIG. 7 is a front perspective view of the mainspring housing of FIG. 2 shown without the set screws and pin.
Figure 8:
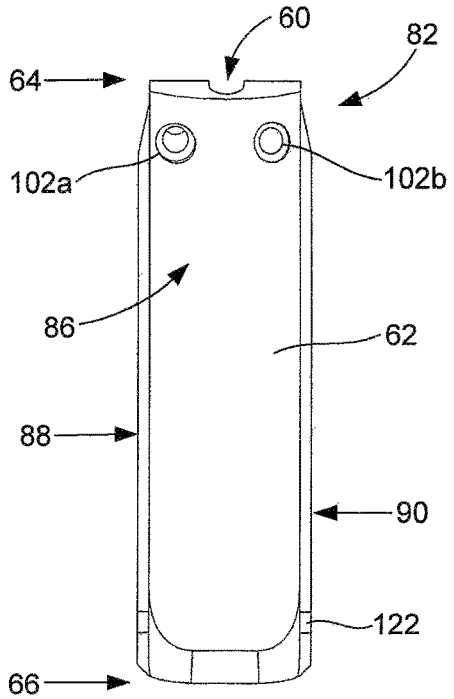
FIG. 8 is a back view of the mainspring housing of FIG. 7.
Figure 10:
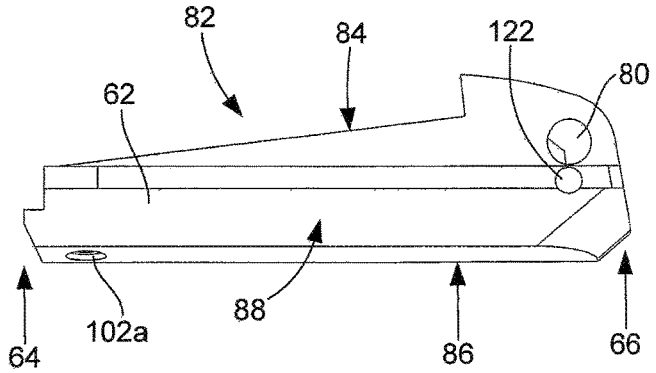
FIG. 10 is a left side view of the mainspring housing of FIG. 7.
Figure 9:
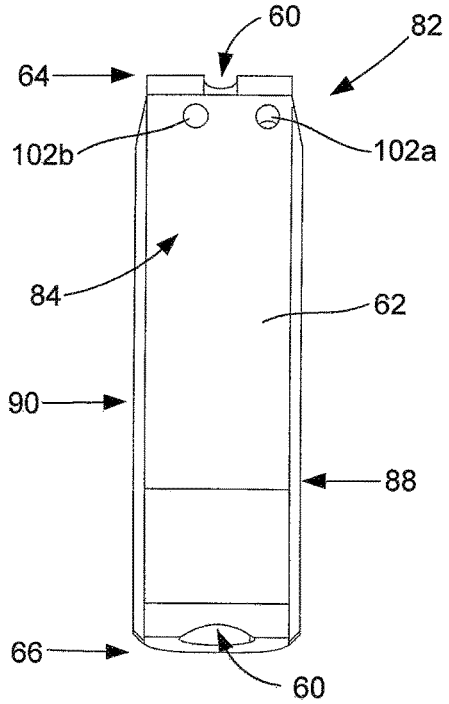
FIG. 9 is a front view of the mainspring housing of FIG. 7.
Figure 11:
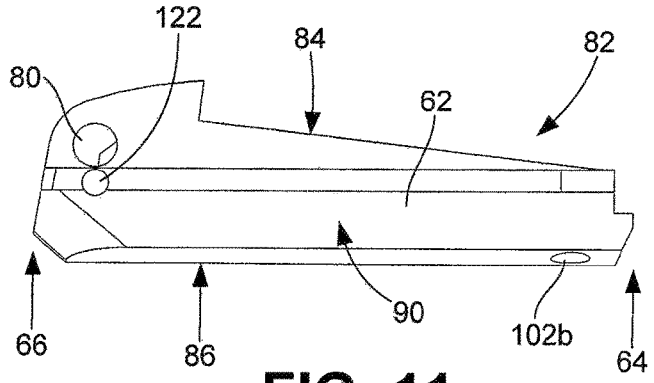
FIG. 11 is a right side view of the mainspring housing of FIG. 7.
Figure 12:
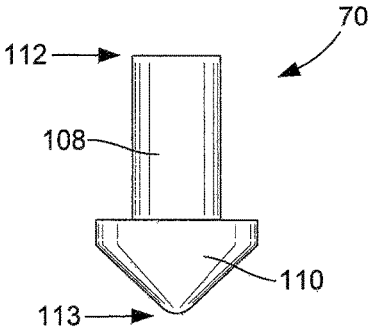
FIG. 12 (PRIOR ART)
FIG. 12 is an enlarged side view of the prior art pin retainer from FIG. 1, which pin retainer is also utilized in a preferred embodiment of the system of the present invention.
Figure 13:
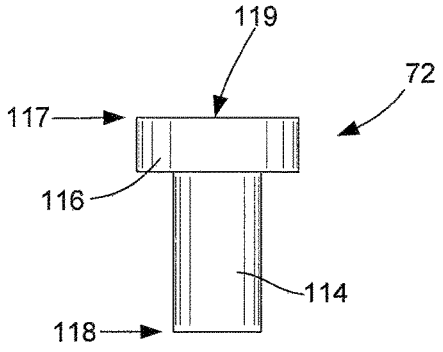
FIG. 13 (PRIOR ART)
FIG. 13 is an enlarged side view of the prior art mainspring cap from FIG. 1, which mainspring cap is also utilized in a preferred embodiment of the system of the present invention.
Figure 14:
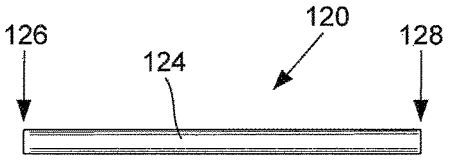
FIG. 14 is a side view of a securing pin that is utilized in a preferred embodiment of the system of the present invention.
Figure 15:
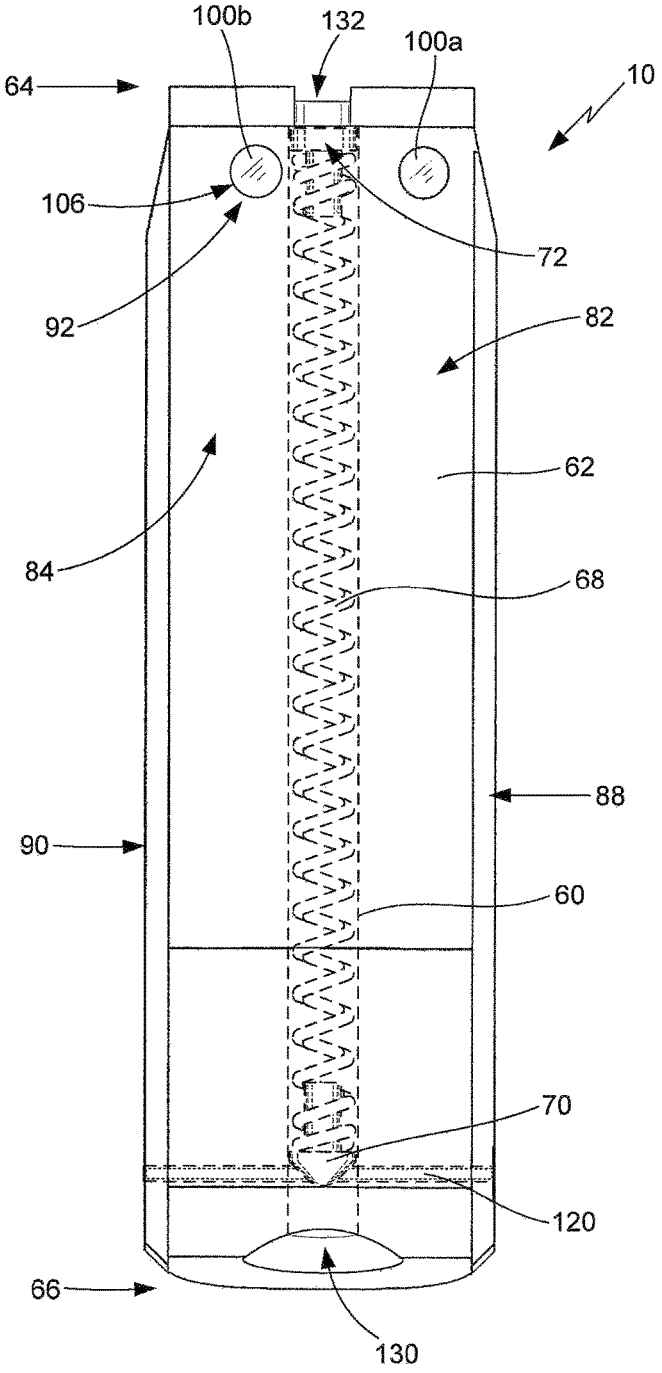
FIG. 15 is a front view of the mainspring housing of FIG. 2 shown with the mainspring, mainspring cap and pin retainer positioned inside the spring passage of the housing body of the mainspring housing, with the pin retainer held in place near the bottom of the mainspring housing by the retaining pin of FIG. 14.
Figure 16:
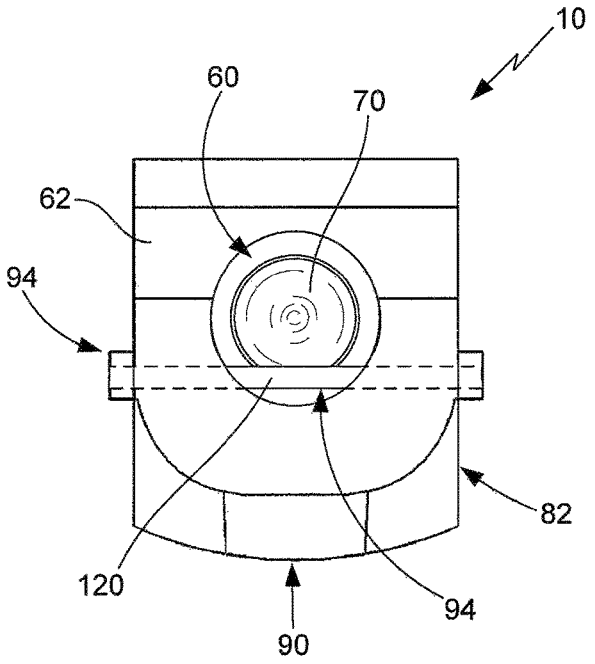
FIG. 16 is a bottom view of the mainspring housing of FIG. 15 showing the retaining pin holding the pin retainer in place near the lower opening of the housing body.

To further accommodate the placement of the engaging devices 100 and device apertures 102 near the upper end 64 of the housing body 62 of the mainspring housing 82, the loading and control of the mainspring 68 is modified. Specifically, in the system 10 of the present invention the mainspring 68 is loaded from the lower end 66 of housing body 62 of the new mainspring housing 82, which is in contrast to the configuration of the prior art mainspring housing 54 where the mainspring 68 is loaded from the upper end 64 of the housing body 62, as shown in FIG. 1. In the preferred embodiment of the system 10 of the present invention, the prior art pin retainer 70 and the prior art mainspring cap 72, shown in FIGS. 1, 12 and 13, are utilized to contain the mainspring 68 in the mainspring housing 82 (as shown in FIGS. 15-16). As shown in FIG. 12, the pin retainer 70 has an upwardly directed cylindrical section 108 and an enlarged section 110 that, respectively, define the first or upper end 112 and the second or lower end 113 of the pin retainer 70. As shown in FIG. 15, the cylindrical section 108 extends upward into the mainspring 68 and the enlarged section 110 is utilized to press against the lower end of the mainspring 68 to help retain (with the mainspring cap 72) the mainspring 68 in the spring passageway 60 above the lower passageway opening 130 at the lower end 66 of the housing body 62 of the mainspring housing 82, as shown in FIGS. 5 and 15-16. The mainspring cap 72 has a downwardly directed cylindrical section 114 and an enlarged section 116 that define, respectively, the first or upper end 117 and the second or lower end 118 of the mainspring cap 72. As shown in FIG. 15, the cylindrical section 114 of mainspring cap 72 extends downward into the mainspring 68 and the enlarged section 116 is utilized to press against the upper end of the mainspring 68 to help retain (with the pin retainer 70) the mainspring 68 in the spring passageway 60 below the upper passageway opening 132 at the upper end 64 of the housing body 62 of the mainspring housing 82, as shown in FIGS. 6 and 15-16. As with the prior art fire control mechanism 14, the lower end of the hammer strut 76 (shown in FIG. 1) engages the upper surface 119 of the enlarged section 116 of mainspring cap 72. As set forth above, the mainspring 68 is biased between the pin retainer 70 at its lower end (toward the lower end 66 of the housing body 62) and the mainspring cap 72 at its upper end 96 (toward the upper end 64 of the housing body 62), as shown in FIG. 15. The retainer securing mechanism 94 is structured and arranged to securely hold the pin retainer 70 in place near the lower end 66 of the housing body 62 of the mainspring housing 82 to allow the mainspring 68 to bias the mainspring cap 72 against the lower end of the hammer strut 76. In the embodiments shown in FIGS. 2-11 and 15-16, the retainer securing mechanism 94 comprises a securing pin 120 that is slidably received in a securing pin aperture 122, which in a preferred embodiment extends across the width of the housing body 62 of mainspring housing 82. The securing pin 120 and securing pin aperture 122 are sized and configured such that securing pin 120 will engage the retaining pin 70 to hold the pin retainer 70 near the lower end 66 of the housing body 62 and retain the mainspring 68 in the spring passageway 60, as shown in FIGS. 15 and 16. In a preferred configuration, the securing pin 120 extends across the housing body 62, including through the spring passageway 60, to abut the lower surface of the enlarged section 110 of the pin retainer 70, as best shown in FIG. 16, and hold the pin retainer 70 in the spring passageway 60 above the lower passageway opening 130, as shown in FIGS. 15 and 16.

Figure 17:
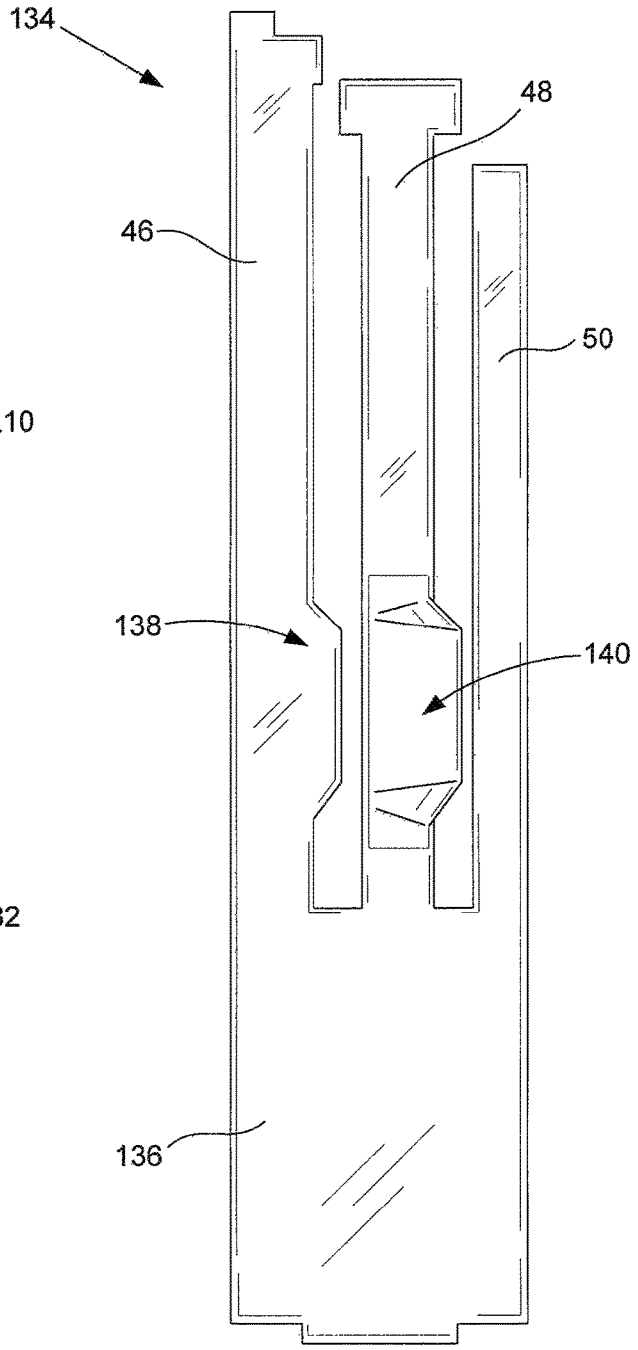
FIG. 17 is a back view of a sear spring that is specially configured for use with the system of the present invention.
Figure 18:
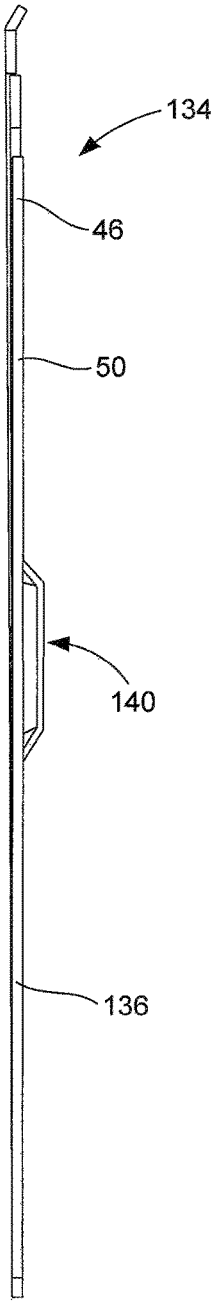
FIG. 18 is a right side view of the sear spring of FIG. 17.
Figure 20:
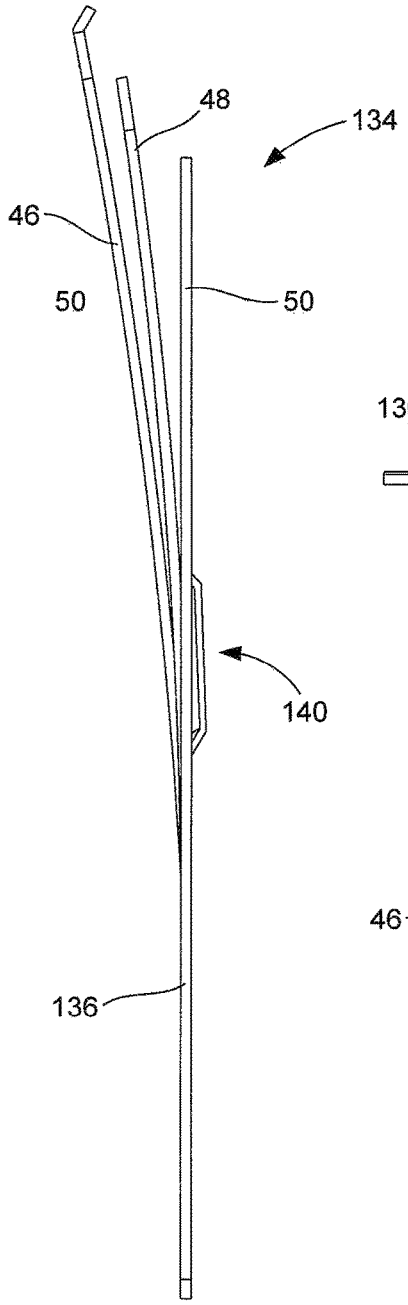
FIG. 20 is a right side view of the sear spring of FIG. 17 with the sear segment and disconnector segment bent outward as they may be utilized in a firearm with the system of the present invention.

In the preferred embodiments of the new adjustable tension system 10 of the present invention, the fire control mechanism 14 also utilizes a specially configured sear spring, shown as 134 in FIGS. 17-21. As with the prior art sear spring 16 shown in FIG. 1, the sear spring 134 has a plurality of elongated spring segments (shown as the sear segment 46, disconnector segment 48 and safety segment 50) that extend outwardly from the base section 136 of the new sear spring 134, as best shown in FIG. 17. As set forth below, although the sear spring 134 is structured and arranged differently than the prior art sear spring 16, the function of the segments 46/48/50 thereof are the same as described above for the prior art spring 16. With regard to the sear segment 46 and disconnector segment 48, these segments are engaged by and moved forward by the forward movement of, respectively, the engaging devices 100*a*/100*b* relative to the housing body 62 or the segments 46/48 are allowed to move rearward by the rearward movement of, respectively, the engaging devices 100*a*/100*b* relative to the housing body 62 (i.e., as the engaging devices 100*a*/100*b* move in their respective device apertures 102*a*/102*b*). Typically, the new sear spring 134 will be made out of the same materials from which the prior art sear spring 16 is made.

Figure 19:
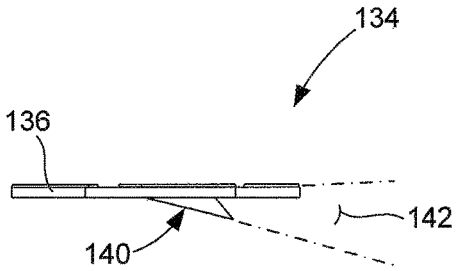
FIG. 19 is a bottom view of the sear spring of FIG. 17.
Figure 21:
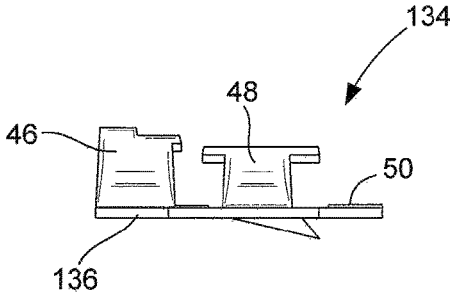
FIG. 21 is a bottom view of the sear spring of FIG. 20
Figure 22:
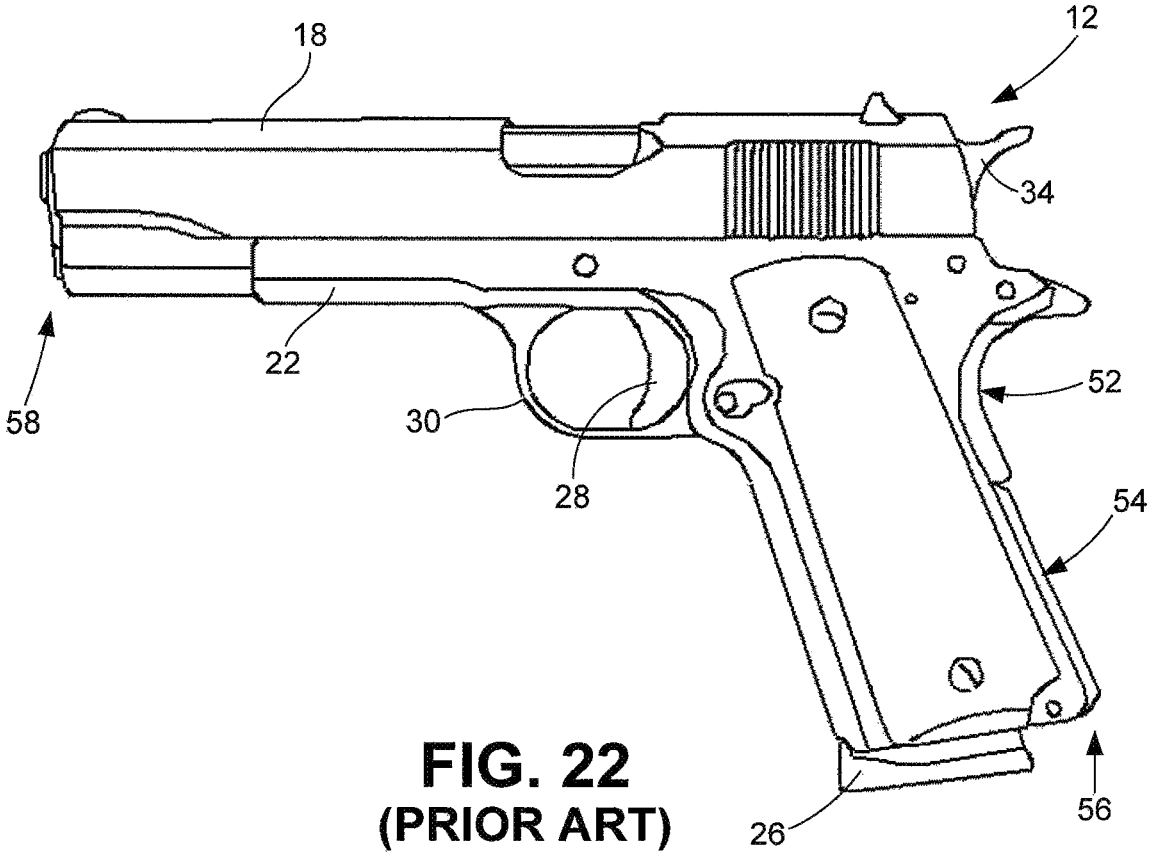
FIG. 22 (PRIOR ART)
FIG. 22 is a side view of a prior art 1911-style handgun that is shown in its assembled condition so as to identify the mainspring housing and grip safety components thereof.
Figure 23:
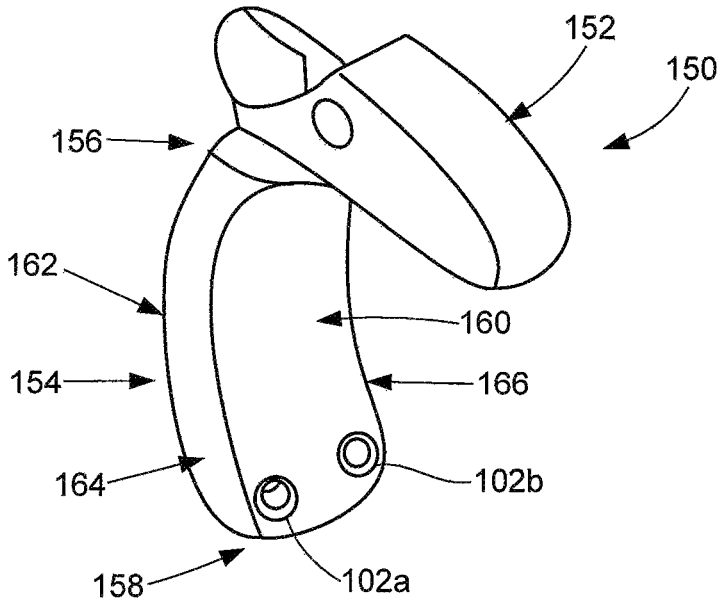
FIG. 23 is a side perspective view of a modified grip safety for use with a second embodiment of the adjustable tension system of the present invention, with the modified grip safety shown with the device apertures but without the engaging devices which will be movably positioned therein.

With regard to the configuration of the new sear spring 134, the sear segment 46 and disconnector segment 48 thereof are modified to better cooperate with the engaging devices 100 of the spring engaging mechanism 92. As shown in FIGS. 17-20, the sear segment 46 of the new sear spring 134 has an enlarged area 138 and the disconnector segment 48 has an enlarged area 140. As will be readily appreciated by those skilled in the art, the enlarged areas 138/140 of the two segments 46/48 provide an increase in area along the elongated segments 46/48 that improves the contact between the engaging devices 100*a*/100*b* and, respectively, the sear segment 46 and the disconnector segment 48 when the user desires to utilize the various features of the system 10 of the present invention to adjust the tension provided by the sear spring 134 to affect the firing characteristics of the firearm 12. As set forth above, the second device aperture 102*b* for the second engaging device 100*b* is at an aperture angle (which is shown as 142 in FIG. 5) to avoid interference with the spring passageway 60 and the mainspring 68 that is disposed therein. This configuration of the second device aperture 102*b* results in the second engaging device 100*b* being at the same angle 142. To compensate for the angle 142 of the second engaging device 100*b* and provide improved contact with the enlarged area 14 of the disconnector segment 48, a preferred configuration of the new sear spring 134 has the enlarged area 140 of the disconnector segment 48 at a segment angle 144 that slopes upward/outward from left to right (as viewed in FIGS. 17-20), as best shown in FIG. 19, so that the enlarged area 140 will be better engaged by the spring engaging end 106 of the second engaging device 100*b*. In one embodiment, the segment angle 144 is approximately ten degrees, as measured from the remaining portion of the elongated disconnector segment 48. The exact angle of the segment angle 144 to achieve the improved contact is likely to depend on various factors, including the aperture angle 142. Although it could be beneficial to have the segment angle 144 to be the same as or generally close to the aperture angle 142, it is unlikely to be entirely necessary or even additionally beneficial. Other than the modifications set forth above, the new sear spring 134 should be sized and configured the same as the prior art sear spring 16 so that it can fit into the firearm 12 and function as the manufacturer intended with regard to the firearm's fire control mechanism 14.

As will be readily appreciated by persons skilled in the art and those who are familiar with firearms 12, particularly the 1911-style handgun, the user will be able to smoothly, quickly and with little effort adjust the tension of the fire control mechanism 14. By placing the first end 104 of the engaging devices 100 on the outside of the new mainspring housing 82, the user will be able to adjust the tension of the fire control mechanism 14 without having to disassemble a portion of the firearm 12 (as described above), manually bend the segments 46/48 of the sear spring 16, reassemble the firearm 12 and then repeatedly disassemble, bend and reassemble the firearm 14 if testing indicates that further adjustment is needed. In addition to significantly simplifying the process of adjusting the tension of the fire control mechanism 14, the new system 10 will virtually eliminate the likelihood that the sear spring 16 will be broken as a result of repeated bending of one or more of the segments 46/48. For those persons who are uncomfortable or unable to utilize the prior art process to adjust the tension themselves, the new system 10 of the present invention will typically allow the vast majority of people to make the adjustments themselves.

In use, the user will replace the existing prior art mainspring housing 54 with the new mainspring housing 82 of the system 10 of the present invention. In one embodiment, the user will be able to utilize the existing sear spring 16, thus requiring no other adjustments or replacements to any other component of the firearm 12. In the preferred configuration, the user will replace the existing sear spring 16 with the new sear spring 134. After removing the prior art mainspring housing 54, by removing the mainspring housing pin 78 and sliding the mainspring housing 54 off of the frame 22, the user will then replace the sear spring 16 with the new sear spring 134. Once the new sear spring 134 is in place, the user will slide the new mainspring housing 82 onto the rearward end 56 of the frame 22 and reinsert the mainspring housing pin 78 back into the apertures in the frame 22 and through the pin aperture 80 in the mainspring housing 82. In one manner of using the system 10, the new mainspring housing 82 will already have the mainspring 68, the sear spring engaging mechanism 92 and the retainer securing mechanism 94 installed and ready for use. In the embodiment shown, the spring engaging mechanism 92 comprises a pair of engaging devices 100 (such as the set screws) and the retainer securing mechanism 94 comprises a securing pin 120, with the mainspring 68 being biased between the pin retainer 70 and the mainspring cap 72, as shown in FIGS. 15-16. As such, once the mainspring housing 82 of the new system is attached to the firearm 12, the user can immediately adjust the tension of the fire control mechanism 14 to his or her desired characteristics. To adjust the tension, the user accesses the spring engaging mechanism 92 and adjusts it as necessary (i.e., rotates the engaging devices 100*a*/100*b*). Because the engaging devices 100 are accessible from outside the firearm 12, the user merely has to use an appropriate tool, such as an Allen wrench, screwdriver, wrench, socket or the like, to rotate the engaging device(s) 100 and increase or decrease the amount of tension applied to the sear 40 and disconnector 42 by, respectively, the sear segment 46 and the disconnector segment 48. Because each of the engaging devices 100 are aligned with and will extend inward to one of the segments 46/48 of the sear spring 16 or 134, rotating the engaging devices 100 will increase or decrease the force against the respective segments 46/48 of the sear spring 16 or 134. The user will individually adjust the sear 40 and/or disconnector 42 to obtain the desired results for the fire control mechanism 14.

The system 10 of the present invention provides a much smoother, easier and faster way of adjusting the tension of the fire control mechanism 14 without the need to modify the grip of the firearm 12, other than to replace the existing mainspring housing 54 with the new mainspring housing 82 (by using factory parts) and the existing sear spring 16 with the new sear spring 134. Once the new mainspring housing 82 is in place, the firearm 12 will feel and perform in the same manner as before except that it will be much easier to adjust the tension of the fire control mechanism 14. The components of the system 10 of the present invention can be made out of a wide variety of materials, including plastic, steel, non-ferrous metals, composites and the like, as long as the materials are sufficiently rigid to accomplish the objectives of the present invention and the normal operation of the mainspring housing 82 and related components. If desired, the system 10 of the present invention (including the mainspring housing 82) can be built into the handle 24 of the firearm 12, as there will be no need to remove the mainspring housing 82. This is in contrast to the prior art mainspring housing 54 which must be made to be moveable to allow modifications to the sear spring 16, namely bending of the segments 46/48, in order to change the tension of the fire control system 14 of a firearm 12.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. An adjustable tension system for use with a firearm having a fire control mechanism comprising a sear, a disconnector and a sear spring disposed inside the firearm, the sear spring having at least a sear segment in engagement with the sear and a disconnector segment in engagement with the disconnector, said system comprising:

a mainspring housing having a housing body with a back wall, said mainspring housing attached to or integrally formed with the firearm so as to be positioned at or near the sear spring of the fire control mechanism with said back wall of said mainspring housing facing generally outward of a rearward end of the firearm; and a spring engaging means moveably supported by said mainspring housing for selectively engaging each of the sear segment and the disconnector segment of the sear spring when said mainspring housing is attached to or integral with the firearm, said spring engaging means structured and arranged to facilitate adjustment of the tension of the fire control mechanism by adjusting the engagement against one or both of the sear segment and the disconnector segment from outside the firearm, said spring engaging means configured to be accessible from outside of the firearm so as to be operatively engaged to apply more or less force against the sear segment and/or the disconnector segment of the sear spring without removing said mainspring housing from the firearm.

2. The system of claim 1, wherein said mainspring housing is configured to be removably attached to a frame of the firearm.

3. The system of claim 2, wherein said housing body has a first sidewall and a second sidewall, each of said first sidewall and said second sidewall being cooperatively configured with the frame of the firearm so said mainspring housing can be slidably engaged with the frame.

4. The system of claim 1, wherein said housing body has an upper end, a lower end, a front wall, a first sidewall, a second sidewall and a spring passageway extending between said upper end and said lower end of said housing body, said spring passageway having a mainspring disposed therein between a mainspring cap at or near said upper end of said mainspring body and a pin retainer at or near said lower end of said mainspring body, at least one of said spring engaging means, said spring passageway and the disconnector segment being structured and arranged so as to not interfere with operation of said mainspring in said spring passageway.

5. The system of claim 1, wherein said spring engaging means has a first engaging device moveably disposed in a first device aperture that extends through said housing body to said back wall of said mainspring housing in alignment with the sear segment of said sear spring and a second engaging device moveably disposed in a second device aperture that extends through said housing body to said back wall of said mainspring housing in alignment with the disconnector segment of the sear spring, each of said first engaging device and second engaging device having a first end accessible from said back wall of said housing body, said first engaging device having a second end that extends forward through said first device aperture to abut the sear segment of the sear spring, said second engaging device having a second end that extends forward through said second device aperture to abut the disconnector segment of the sear spring, said first end of said first engaging device configured so as to be operatively engaged to move said second end thereof to apply more or less force against the sear segment of the sear spring, said first end of said second engaging device configured so as to be operatively engaged to move said second end thereof to apply more or less force against the disconnector segment of the sear spring.

6. The system of claim 5, wherein said housing body has a spring passageway with a mainspring disposed therein and at least one of said spring engaging means, said spring passageway and the disconnector segment are structured and arranged so as to not interfere with operation of said mainspring in said spring passageway.

7. The system of claim 6, wherein said second device aperture is offset from being perpendicular to one of front wall and said back wall of said mainspring housing at an aperture angle that is selected so said engaging device will not interfere with operation of said mainspring in said spring passageway.

8. The system of claim 1, wherein the disconnector segment of the sear spring comprises an enlarged area that is sized and configured to be engaged by said spring engaging means so as to facilitate adjustment of the fire control mechanism of the firearm by movement of said spring engaging means against the disconnector segment.

9. An adjustable tension system for use with a firearm having a fire control mechanism comprising a sear, a disconnector and a sear spring disposed inside the firearm, the sear spring having at least a sear segment in engagement with the sear and a disconnector segment in engagement with the disconnector, said system comprising:

a mainspring housing having a housing body with an upper end, a lower end, a back wall, a front wall and a spring passageway extending at least generally between said upper end and said lower end between said back wall and said forward wall of said housing body, said mainspring housing configured to be removably attached to the firearm with said back wall of said mainspring housing facing generally outward of a rearward end of the firearm and said front wall of said mainspring housing facing generally forward into the firearm toward the sear spring of the fire control mechanism;

a mainspring disposed in said spring passageway of said mainspring housing;

a first device aperture extending through said housing body to said back wall of said mainspring housing in alignment with the sear segment of the sear spring;

an first engaging device moveably disposed in said first device aperture for selectively engaging the sear segment of the sear spring when said mainspring housing is attached to the firearm, said first engaging device structured and arranged to facilitate adjustment of the tension of the fire control mechanism from outside the firearm, said first engaging device having a first end accessible said back wall of said housing body and a second end that extends forward of said front wall of said housing body to abut the sear segment of the sear spring, said first end of said first engaging device configured to be operatively engaged to move said first engaging device forward and rearward in said first device aperture so as to apply more or less force against the sear segment of the sear spring;

a second device aperture extending through said housing body to said back wall of said mainspring housing in alignment with the disconnector segment of the sear spring; and a second engaging device moveably disposed in said second device aperture for selectively engaging the disconnector segment of the sear spring when said mainspring housing is attached to the firearm, said second engaging device structured and arranged to facilitate adjustment of the tension of the fire control mechanism from outside the firearm, said second engaging device having a first end accessible from said back wall of said housing body and a second end that extends forward of said front wall of said housing body to abut the disconnector segment of the sear spring, said first end of said second engaging device configured to be operatively engaged in order to move said second engaging device forward and rearward in said second device aperture so as to apply more or less force against the disconnector segment of the sear spring.

10. The system of claim 9, wherein said housing body has a first sidewall and a second sidewall, each of said first sidewall and said second sidewall being cooperatively configured with a frame of the firearm so said mainspring housing can be slidably engaged with the frame.

11. The system of claim 9, wherein said mainspring is disposed in said spring passageway between a mainspring cap at said upper end of said mainspring body and a pin retainer at said lower end of said mainspring body, each of said mainspring cap, pin retainer and mainspring are removably received in said spring passageway from said lower end of said housing body, said mainspring cap having an enlarged section that is cooperatively sized and configured with said spring passageway so as to prevent said mainspring cap from exiting said spring passageway at said upper end of said body of said mainspring housing.

12. The system of claim 11 further comprising a retainer securing mechanism at or near said lower end of said housing body of said mainspring housing, said retainer securing mechanism structured and arranged to engage said pin retainer when said pin retainer is in said spring passageway so as to secure said mainspring in said spring passageway.

13. The system of claim 11, wherein at least one of said second device aperture, said second engaging device, said spring passageway and the disconnector segment being structured and arranged so as to not interfere with operation of said mainspring in said spring passageway.

14. The system of claim 9, wherein the disconnector segment of the sear spring comprises an enlarged area that is sized and configured to be engaged by said second engaging device so as to facilitate adjustment of the fire control mechanism of the firearm by movement of said second engaging device against the disconnector segment.

15. The system of claim 9, wherein at least one of said second device aperture, said second engaging device, said spring passageway and the disconnector segment being structured and arranged so as to not interfere with operation of said mainspring in said spring passageway.

16. An adjustable tension system for use with a firearm having a fire control mechanism with a sear spring having at least a sear segment and a disconnector segment, said system comprising:

a mainspring housing having a housing body with an upper end, a lower end, a front wall, a back wall, a first sidewall, a second sidewall and a spring passageway extending between said upper end and said lower end of said housing body, said mainspring housing configured to be removably attached to the firearm at or near the fire control mechanism thereof with said back wall facing outward of a rearward end of the firearm and said forward wall facing forward into the firearm generally toward the sear spring of the fire control mechanism;

a mainspring disposed in said spring passageway of said mainspring housing; and a spring engaging means supported by said mainspring housing for selectively engaging the sear spring in the firearm when said mainspring housing is attached to the firearm so as to adjust the tension of the fire control mechanism, said spring engaging means comprising a first engaging device that is moveably disposed in a first device aperture and a second engaging device that is movably disposed in a second device aperture, each of said first device aperture and said second device aperture extending between said front wall and said back wall of said housing body, said first device aperture positioned so as to align said first engaging device with the sear segment, said second device aperture positioned so as to align said second engaging device with the disconnector segment, each of said first engaging device and said second engaging device having a first end accessible from rearward of said back wall of said housing body and a second end that extends forward of said front wall of said housing body to abut the sear segment or the disconnector segment of the sear spring, said first end of said first engaging device configured to be operatively engaged to move said first engaging device forward and rearward in said first device aperture so as to apply more or less force against the sear segment of the sear spring, said first end of said second engaging device configured to be operatively engaged to move said second engaging device forward and rearward in said second device aperture so as to apply more or less force against the disconnector segment of the sear spring.

17. The system of claim 16, wherein said first engaging device is threadably received in said first device aperture and said second engaging device is threadably received in said second device aperture.

18. The system of claim 16, wherein said mainspring is disposed in said spring passageway between a mainspring cap at said upper end of said mainspring body and a pin retainer at said lower end of said mainspring body, each of said mainspring cap, pin retainer and mainspring removably received in said spring passageway from said lower end of said housing body, said mainspring cap having an enlarged section that is sized and configured to prevent said mainspring cap from exiting said spring passageway at said upper end of said body of said mainspring housing.

19. The system of claim 18 further comprising a securing pin at or near said lower end of said housing body, said securing pin structured and arranged to engage said pin retainer when said pin retainer is in said spring passageway so as to secure said mainspring in said spring passageway.

20. The system of claim 16, wherein the sear segment comprises an enlarged area that is sized and configured to be engaged by said first engaging device and the disconnector segment comprises an enlarged area that is sized and configured to be engaged by said second engaging device.

21. The system of claim 16, wherein at least one of said second device aperture, said second engaging device, said spring passageway and the disconnector segment being structured and arranged so as to not interfere with operation of said mainspring in said spring passageway.

* * * * *